US009540880B2

(12) United States Patent
McElhinney et al.

(10) Patent No.: US 9,540,880 B2
(45) Date of Patent: Jan. 10, 2017

(54) MAGNETIC LATCHING DEVICE FOR DOWNHOLE WELLBORE INTERCEPT OPERATIONS

(75) Inventors: Graham Arthur McElhinney, Aberdeenshire (GB); Charles Henry Duck, Jr., Cottonport, LA (US); Christopher William Lillis, Glasgow (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 457 days.

(21) Appl. No.: 13/819,201

(22) PCT Filed: Aug. 26, 2011 (Under 37 CFR 1.47)

(86) PCT No.: PCT/US2011/049280
§ 371 (c)(1), (2), (4) Date: Oct. 14, 2013

(87) PCT Pub. No.: WO2012/027637
PCT Pub. Date: Mar. 1, 2012

(65) Prior Publication Data

US 2015/0034312 A1 Feb. 5, 2015

Related U.S. Application Data

(60) Provisional application No. 61/377,119, filed on Aug. 26, 2010.

(51) Int. Cl.

| | |
|---|---|
| ***E21B 7/06*** | (2006.01) |
| ***E21B 47/09*** | (2012.01) |
| ***E21B 17/10*** | (2006.01) |
| ***E21B 47/022*** | (2012.01) |
| ***E21B 43/117*** | (2006.01) |

(52) U.S. Cl.
CPC ..... *E21B 7/06* (2013.01); *E21B 17/1078* (2013.01); *E21B 43/117* (2013.01); *E21B 47/022* (2013.01); *E21B 47/02216* (2013.01); *E21B 47/09* (2013.01)

(58) Field of Classification Search
CPC ..... E21B 7/06; E21B 43/117; E21B 47/022; E21B 47/09; E21B 47/02216; E21B 17/1078
USPC . 166/66.5, 250.01; 175/45, 61, 73; 324/323, 324/346
See application file for complete search history.

(56) References Cited

U.S. PATENT DOCUMENTS 3,637,033 A * 1/1972 Mayall ..... E21B 17/00 166/66.5
5,084,678 A 1/1992 Hutin
5,589,775 A * 12/1996 Kuckes ..... G01V 3/26 166/66.5

(Continued)

OTHER PUBLICATIONS

International Search Report for PCT Application Serial No. PCT/US2011/049280 dated Jan. 9, 2012.

*Primary Examiner* — Michael Wills, III
(74) *Attorney, Agent, or Firm* — Stephanie Chi

(57) ABSTRACT

A downhole magnetic latching tool includes at least one permanent magnet deployed on a non-magnetic tool body. A magnetically permeable housing is deployed about the permanent magnet. The magnetic latching tool provides an attractive magnetic force between a drill string and a cased target wellbore.

9 Claims, 3 Drawing Sheets

(56) References Cited

U.S. PATENT DOCUMENTS

| | | | | |
|---|---|---|---|---|
| 6,357,539 | B1 * | 3/2002 | Ruttley | E21B 31/06 166/66.5 |
| 6,655,462 | B1 * | 12/2003 | Carmichael | E21B 31/06 166/173 |
| 6,985,814 | B2 * | 1/2006 | McElhinney | G01V 3/26 175/45 |
| 7,219,724 | B2 * | 5/2007 | Theriot, Sr. | B08B 9/0436 166/66.5 |
| 2002/0056666 | A1 * | 5/2002 | Sharaf | C02F 1/481 209/214 |
| 2002/0144417 | A1 | 10/2002 | Russell et al. | |
| 2003/0085059 | A1 | 5/2003 | Kuckes et al. | |
| 2003/0179651 | A1 | 9/2003 | Nutt et al. | |
| 2008/0041626 | A1 | 2/2008 | Clark | |
| 2008/0202756 | A1 * | 8/2008 | Borst | E21B 37/00 166/304 |
| 2009/0201025 | A1 * | 8/2009 | McElhinney | E21B 47/02216 324/346 |
| 2010/0194395 | A1 | 8/2010 | McElhinney | |
| 2011/0284203 | A1 * | 11/2011 | Hern | E21B 37/00 166/66.5 |

* cited by examiner

MAGNETIC LATCHING DEVICE FOR DOWNHOLE WELLBORE INTERCEPT OPERATIONS

RELATED APPLICATIONS

This application claims the benefit of: U.S. Provisional Application Ser. No. 61/377,119 filed Aug. 26, 2010 and entitled Magnetic Device for Latching a Drilling BHA onto the Target Well.

BACKGROUND

The present invention relates generally to subterranean well intercept operations commonly utilized in oil and natural gas exploration and production. In particular, this invention relates to an apparatus and method for intercepting and penetrating a cased target well, for example, during near-parallel well intercept operations.

Wellbore intercept operations are common in various downhole drilling operations, for example, in well kill operations, relief well operations, and coal bed methane (CBM) drilling operations in which a horizontal well is intended to intercept multiple vertical pilot wells. Well intercept operations have also been proposed for certain well abandonment operations. When oil and gas wells are no longer commercially viable, they must typically be abandoned in accordance with local government regulations. These regulations vary from one jurisdiction to another, however, generally require one or more permanent barriers to isolate the wellbore. More recently certain jurisdictions have proposed and/or required that additional isolation be employed in some previously abandoned wells. The additional isolation required can vary (e.g., it may include the deployment of a cement plug in the well), but generally requires access to the well. One significant difficulty in these operations is that there may be no longer surface accessibility to many of these wells.

Well intercept operations (also referred to in the art as well interception operations) have been used with some success to obtain access to the previously drilled wells. However, many well intercept operations fail due to the difficultly in positioning the drilling well in the correct location and orientation adjacent to the target well. This difficulty is magnified in well abandonment operations due to the requirement that the drilling well penetrate the target well casing. The invention disclosed herein is intended to address these difficulties.

SUMMARY

Exemplary aspects of the invention disclosed herein are intended to address the above described difficulties in intercepting and penetrating a previously drilled cased wellbore. In one exemplary embodiment of the invention, a magnetic latching tool is provided for near-parallel wellbore intercept operations. The disclosed magnetic latching tool includes at least one permanent magnet deployed on a nonmagnetic downhole tool body. In preferred embodiments, a plurality of permanent magnets is circumferentially aligned with one another on the tool body. The magnets are preferably magnetized in a radial direction (i.e., perpendicular to the longitudinal axis of the tool body) and include common magnetic poles on the outer surface thereof. A magnetically permeable housing is deployed about and preferably in contact with the magnets.

Exemplary embodiments of the disclosed invention may provide several advantages. For example, the magnetic latching tool provides an attractive magnetic force between the drill string and the cased target wellbore. The attractive force enables the latching tool to be magnetically coupled with the target well and therefore tends to enable the drill string to penetrate the target well casing in a near-parallel intercept operation. The attractive force also enables the drilling well to be rotational aligned with the target well (e.g., such that a bent sub points towards the target well or such that perforating guns may be directed towards the target well).

In one embodiment, the disclosed invention includes a plurality of permanent magnets deployed on an outer surface of a nonmagnetic downhole tool body. The permanent magnets are circumferentially aligned with one another and magnetized in a direction substantially perpendicular to a longitudinal axis of the downhole tool body such that each of the magnets has a common magnetic pole on an outer surface thereof. A magnetically permeable housing is deployed about the plurality of permanent magnets and in contact with the outer surfaces of each of the magnets.

In another embodiment, the disclosed invention includes a method for intercepting and penetrating a cased subterranean target wellbore. The method includes deploying a drill string in a drilling well, the drill string including a drill bit and a magnetic latching tool. The magnetic latching tool includes a plurality of permanent magnets deployed on an outer surface of a nonmagnetic tool body, the permanent magnets being circumferentially aligned with one another on the tool body and magnetized in a radial direction. The magnetic latching tool further includes a magnetically permeable housing deployed about the plurality of permanent magnets and in contact with the outer surfaces of each of the magnets. The drilling well is drilled substantially parallel with and adjacent to the cased target wellbore. The drill string is then rotated so that the permanent magnets magnetically engage the cased target wellbore. An opening is then formed in the cased target wellbore.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of exemplary embodiments of the invention disclosed herein, and advantages thereof, reference is now made to the following descriptions taken in conjunction with the accompanying drawings, in which.

DETAILED DESCRIPTION

Figure 1:
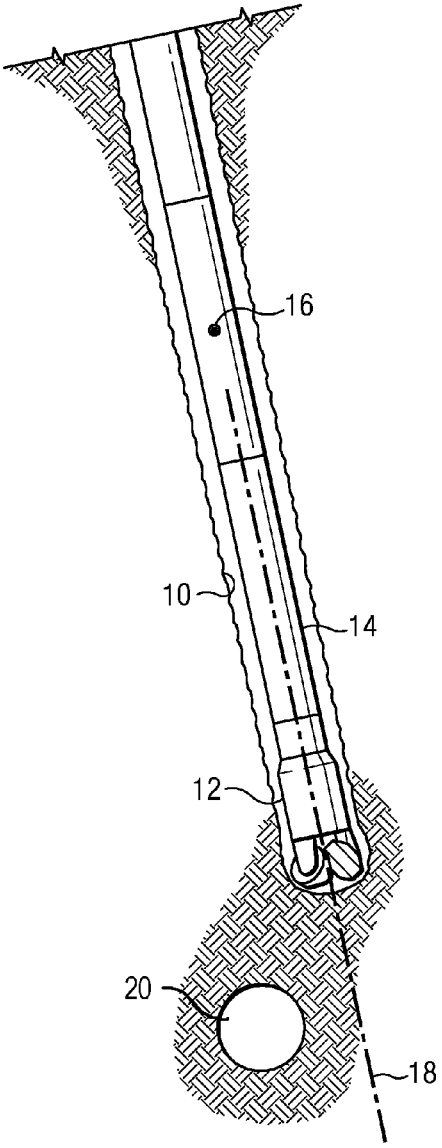
FIG. 1 (PRIOR ART)
FIG. 1 depicts a prior art well intercept operation.

FIG. 1 depicts a plan view of a prior art well twinning operation in which a drilling well 10 is being drilled towards a target well 20. It will be understood by those of ordinary skill in the art that such operations are known, for example, in coal bed methane (CBM) drilling operations. In the exemplary embodiment depicted, the drill string typically employs a conventional drill bit 12, a steering tool 14 (such as a rotary steerable tool or a mud motor in combination with a bent sub), and a surveying apparatus 16 (e.g., including magnetic field and gravitational field sensors). The surveying apparatus may be utilized to make conventional borehole inclination and borehole azimuth measurements as well as magnetic ranging measurements.

One difficulty with conventional well intercept operations is that the uncertainties associated with making and interpreting survey measurements (for example, inclination, azimuth, and measured depth) accumulate with increasing measured depth. In well intercept operations the absolute uncertainty of the position of each well is generally significantly larger than the requirement for placement of the drilling well. As a result, the drilling well is often drilled past the target well (i.e., it misses the target well as indicated at 18 on FIG. 1). In operations employing magnetic ranging measurements, sensors used to make the ranging measurements are commonly deployed a significant distance behind the bit (e.g., 15 to 20 meters) in a non-magnetic section of the bottom hole assembly (BHA). Those of ordinary skill in the art will appreciate that such a deployment increases the time between cutting (drilling) and ranging. In non-parallel well intercept operations the target is typically not detected until the drill bit has already drilled past the target. In order to intercept the target well, the drill string may pulled uphole and a new drilling well is sidetracked off of the original. In practice, multiple sidetracks are commonly required to achieve an acceptable intercept. This process is both time consuming and expensive and is therefore generally unsuitable for well abandonment operations (in which minimizing costs is often of paramount importance).

Figure 2:
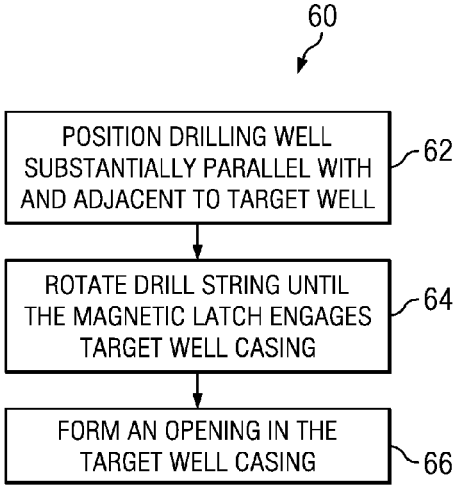
FIG. 2 depicts a flow chart of one exemplary method embodiment in accordance with principles of the invention.

FIG. 2 depicts a flow chart of one exemplary method embodiment 60 for intercepting and penetrating a subterranean wellbore. The method includes positioning the drilling well substantially parallel with and adjacent to the target well at 62. The drill string is then rotated at 64 until a magnetic latch deployed in the drill string magnetically engages the target well casing. An opening is then formed in the target well casing at 66, for example, via milling/drilling into the casing or detonating an explosive charge adjacent to the casing.

Figure 3:
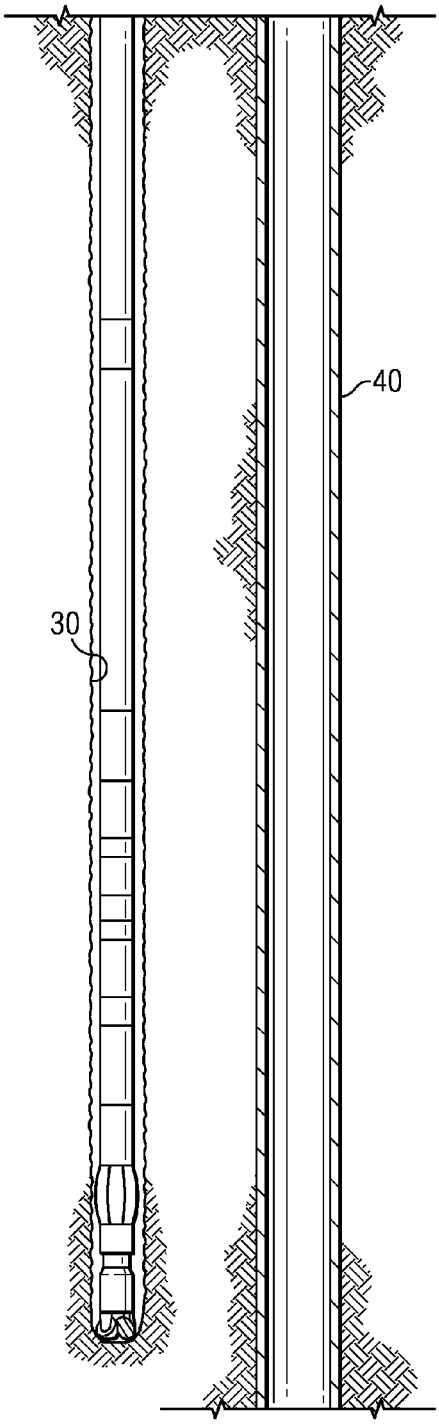
FIG. 3 depicts a prior art near parallel well twinning operation.

FIG. 3 depicts a near-parallel well twinning operation in which a twin well 30 is drilled and thereby positioned substantially parallel with and in magnetic sensory range of a cased target well 40. The drilling well may be positioned substantially parallel with and adjacent to the target well using substantially any known surveying and/or well twinning techniques. In preferred embodiments of the invention magnetic passive ranging techniques may be utilized to position the twin well in 62. U.S. Pat. No. 6,985,814 to McElhinney, which is fully incorporated by reference herein, discloses a passive magnetic ranging technique for well twinning in which the remnant magnetic field from magnetic particle inspection (MPI) techniques remaining in the target well casing is sensed from the drilling well and used to compute a distance and direction between the twin and target wells. The distance and direction may then be further processed to obtain a direction for subsequent drilling of the twin well.

In embodiments in which passive ranging measurements are utilized, positioning the well in 62 may include (i) measuring local magnetic fields at first and second positions in the drilling well, (ii) processing the local magnetic fields at the first and second positions and a reference magnetic field to determine interference magnetic fields (i.e., the portion of the local magnetic fields attributable to the target well), and (iii) processing the interference magnetic fields to determine a range and bearing to the target well (i.e., a distance and direction also referred to in the '814 patent as a distance and a tool face to target angle). Positioning the well may alternatively further include: (iv) processing the range and bearing to determine a direction for subsequent drilling and (v) drilling the drilling well along the direction for subsequent drilling.

In order to promote a strong magnetic latching force (via reducing the distance between the magnetic latch and the target well), the direction for subsequent drilling is preferably selected such that the drilling well is drilled as close as possible to the twin well. For example only, the direction for subsequent drilling may be selected so as to decrease the distance (range) between the twin and target wells until the twin well contacts (or essentially contacts) the target well casing. Drilling may continue until the magnetic latch (described in more detail below) also contacts (or nearly contacts) the target well.

Figure 4:
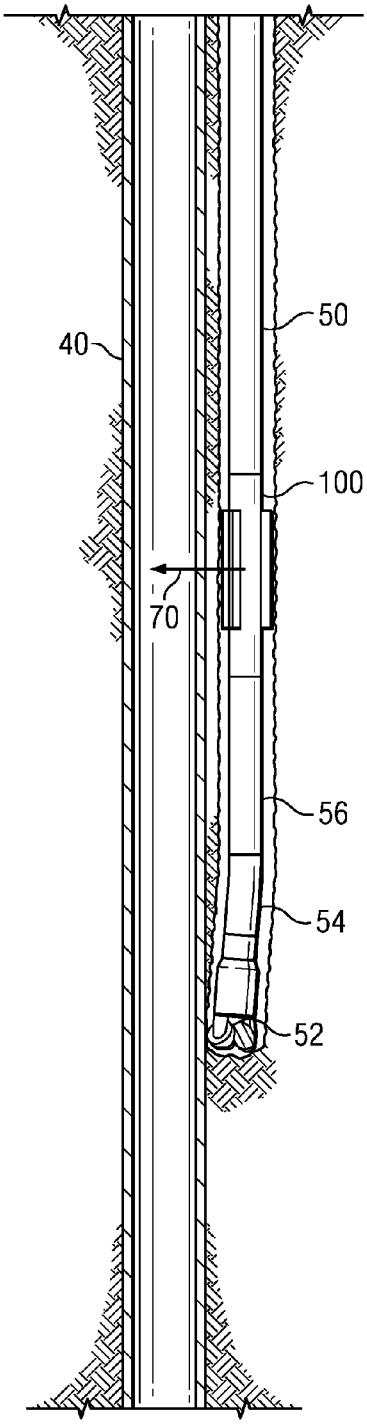
FIG. 4 depicts one exemplary embodiment of a near parallel well intercept operation in accordance with principles of the invention disclosed herein.

FIG. 4 depicts one exemplary embodiment of a near parallel well intercept operation in which the magnetic latching tool 100 is engaging the target well casing string. In the exemplary embodiment depicted, drill string 50 includes a mud motor 56 and a bent sub 54 deployed just above drill bit 52. The drill string further includes a downhole magnetic latching tool 100 configured in accordance with principles of the invention. As depicted, the bent sub 54 is oriented such that the drill bit is pointing towards the target well 40 when the magnetic latch is magnetically engaged with the target well casing string. The magnetic latching tool 100 is configured to provide a strong attractive magnetic force 70 with the target casing when rotated to the proper tool face angle. The attractive magnetic force is intended to be strong enough so as to secure the drill string 50 to the target well casing 70 and enable milling/drilling of the casing. One exemplary embodiment of magnetic latching tool 100 is described in more detail below with respect to FIGS. 5 and 6.

It will be understood by those of ordinary skill on the art that the invention is not limited to embodiments in which a bent sub and mud motor are utilized. In alternative embodiments of the invention, the drill string may include substantially any suitable steering tool for example, including conventional 2-D and 3-D rotary steerable tools. Since the tool face direction of the attractive magnetic force is known, substantially any steerable tool may be configured to steer the drill bit into contact with the target well casing thereby enabling milling/drilling off the casing.

Figure 5A:
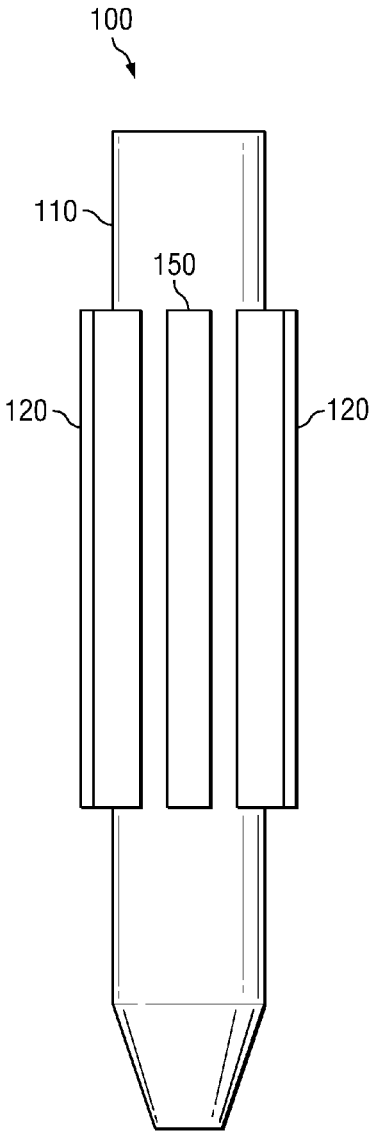
FIGS. 5A and 5B depict one exemplary downhole tool embodiment in accordance with principles of the invention disclosed herein.
Figure 5B:
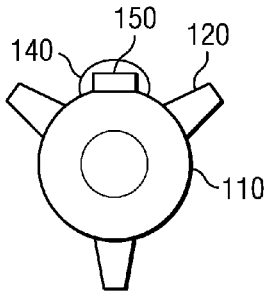

FIGS. 5A and 5B depict one exemplary embodiment of magnetic latching tool 100. The exemplary embodiment depicted includes a tool body which is configured to couple with a drill string (and therefore typically includes upper and lower threaded ends). The tool body 110 is preferably constructed from non-magnetic steel and includes stabilizer fins 120 configured to substantially center the tool 100 in the borehole. It will be understood that the invention is not limited in this regard, as the stabilizer fins may also be configured to eccenter the tool 100 in the borehole.

Latching tool 100 further includes at least one permanent magnet 150 deployed on or in the tool body 100. In the exemplary embodiment depicted, a plurality of permanent magnets 150 are mounted on an outer surface of the total body 110 and housed in a magnetically permeable housing 140. The housing is intended to both physically protect the magnets and to enable magnetic flux from the magnets 150 to propagate radially outward from the tool body 110. As such, an inner surface of the housing 140 preferably contacts the outer surfaces of the magnets 150. In alternative embodiments the magnets 150 may be mounted in corresponding slots formed in the wall of the tool body or in a frame or housing deployed on the tool body 110. The invention is expressly not limited to any particular means or structure for mounting the magnets to the tool body.

With continued reference to FIGS. 5A and 5B, magnets 150 are configured to provide a cross-axial magnetic force (i.e., a magnetic force in a direction substantially orthogonal to the longitudinal axis of the tool 100—such as force 70 in FIG. 4). While the invention is not limited to any particular type of magnet, it is generally preferable that the magnets provide a strong magnetic force and be configured to withstand the high temperatures encountered in downhole drilling operations. Rare earth magnets such as Neodymium magnets and Samarium Cobalt magnets tend to provide a very strong magnetic force and therefore may be advantageously utilized. Isotropic and Anisotropic Ferrite, Alnico alloys, and Samarium Cobalt alloys are typically suitable at high temperatures (e.g., at temperatures exceeding 250 degrees C.) and therefore may also be advantageously utilized. Samarium Cobalt magnets are most preferred in that they provide a strong magnetic force and are suitable at high temperatures.

In preferred embodiments of the disclosed invention Sintered Rectangular Samarium Cobalt magnets are utilized as they provide a large magnetic force across the face of the magnet. The rectangular magnets are preferably magnetized through the thickness of the rectangular magnets. For example only, Samarium Cobalt 26 magnets having a dimension of 2"×2"×1" and being magnetized through the one inch thickness of the rectangle may be advantageously utilized. In such an embodiment, each magnet provides a pull force of approximately 130 pounds. It will be understood that the term pull force typically refers the perpendicular force required to pull a magnet free from a flat steel plate (and therefore may be thought of as defining the holding power of a magnet).

Figure 6:
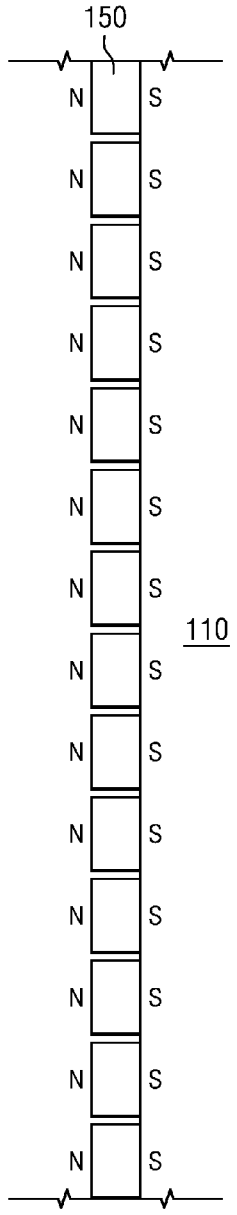
FIG. 6 depicts one exemplary embodiment of the permanent magnets shown on FIGS. 5A and 5B.

FIG. 6 depicts one exemplary embodiment of a magnets 150 mounted on tool body 110. Magnetically permeable housing 140 is not shown for convenience. In the exemplary embodiment depicted, the magnets 150 are deployed on the tool body along a line parallel with the longitudinal axis of the tool 100. Each magnet is arranged so that its North Pole (N) points radially outward and its South Pole (S) points radially inward. It will of course be understood that the N pole may point inward and the S pole outward. The invention is not limited in these regards.

It will be understood that substantially any suitable number of magnets 150 may be utilized, depending upon the particular application. In operations in which a hole is to be milled/drilled through the target well casing, a large number of magnets may be desirable so as to provide a large magnetic latching force (e.g., 10, 20, 30, 40, 50, or more). For example only, an embodiment including 20 Samarium 26 magnets (described above) would be expected to provided a latching force on the order of 2600 pounds (provided that the magnetically permeable housing contacts the target well casing). Embodiments having a larger number of magnets generally provide a larger latching force. Smaller magnetic forces may be suitable in operations in which an explosive charge is detonated to open the target well casing.

Weight on bit sensors may be advantageously utilized to determine whether or not the magnets 150 are latched onto (i.e., magnetically engaged with) the target well casing. For example, the drill string may first be lifted off the bottom of the drilling well. The upward force required to move the string in the upward direction (while off bottom) may then be measured. It will be understood that if the drill string is off bottom and the magnets are latched on to the target well casing, then additional force is generally required to move the drill string in the upward direction (e.g., up to 2600 pounds in embodiments utilizing 20 Samarium 26 magnets). The force required to move the drill string in the downward direction may also be measured. Likewise, additional force is generally required to move the drill string further down in to the drilling well (e.g. up to about 2600 pounds will need to be released in order to move the string downward). Summing these forces yields a differential weight on bit that may be evaluated to enable an operator to determine whether or not the magnetic latch is magnetically engaged with the target well casing string. Moreover, the magnitude of the force differential enables the operator to estimate the distance between the magnetic latch and the target well casing (as those of ordinary skill in the art will readily appreciate that the magnetic pull force decreases sharply with increasing distance between the magnets in the target well casing).

Although the present invention and its advantages have been described in detail, it should be understood that various changes, substitutions and alternations can be made herein without departing from the spirit and scope of the invention as defined by the appended claims.

We claim:

1. A method for intercepting and penetrating a cased subterranean target wellbore, the method comprising:

(a) deploying a drill string in a drilling well, the drill string including a drill bit and a magnetic latching tool, the magnetic latching tool including a plurality of permanent magnets deployed on an outer surface of a non-magnetic tool body, the permanent magnets being circumferentially aligned with one another on the tool body and magnetized in a radial direction, the magnetic latching tool further including a magnetically permeable housing deployed about the plurality of permanent magnets and in contact with the outer surfaces of each of the magnets;

(b) drilling the drilling well substantially parallel with and adjacent to the cased target wellbore;

(c) rotating the drill string so that the permanent magnets magnetically engage the cased target wellbore; and (d) forming an opening in the cased target wellbore.

2. The method of claim 1, wherein the opening is formed in (d) via a drilling operation using the drill bit.

3. The method of claim 1, wherein the opening is formed in (d) via detonating an explosive charge in close proximity to the cased target wellbore.

4. The method of claim 1, wherein (b) further comprises: measuring local magnetic fields at first and second positions in the drilling well;

(ii) processing the local magnetic fields at the first and second positions and a reference magnetic field to determine interference magnetic fields; and (iii) processing the interference magnetic fields to determine a range and bearing to the target well.

5. The method of claim 4, wherein (b) further comprises:

(iv) processing the range and bearing to determine a direction for subsequent drilling; and (v) drilling the drilling well along the direction for subsequent drilling.

6. The method of claim 5, wherein the direction for subsequent drilling is selected such that the drilling well physically contacts the cased target wellbore.

7. The method of claim 1, wherein the drilling well physically contacts the cased target wellbore in (b).

8. The method of claim 1, wherein (c) further comprises measuring a differential weight on bit to indicate whether or not the permanent magnets have magnetically engaged the cased target wellbore.

9. The method of claim 1, wherein (c) further comprises:

(i) lifting the drill string off bottom;

(ii) measuring a force required to move the drill string in the upward direction;

(iii) measuring a force required to move the drill string in a downward direction;

(iv) summing the forces obtained in (ii) and (iii) to obtain a differential force; and (v) evaluating the differential force to determine whether or not the permanent magnets are magnetically engaged with the cased target wellbore.

* * * * *